US011959157B2

(12) United States Patent
Izumi et al.

(10) Patent No.: US 11,959,157 B2
(45) Date of Patent: Apr. 16, 2024

(54) HIGH-MN STEEL AND METHOD OF PRODUCING SAME

(71) Applicant: JFE STEEL CORPORATION, Tokyo (JP)

(72) Inventors: Daichi Izumi, Tokyo (JP); Shigeki Kitsuya, Tokyo (JP); Keiji Ueda, Tokyo (JP); Koichi Nakashima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 488 days.

(21) Appl. No.: 17/264,295

(22) PCT Filed: Jul. 31, 2019

(86) PCT No.: PCT/JP2019/030051
§ 371 (c)(1),
(2) Date: Jan. 29, 2021

(87) PCT Pub. No.: WO2020/027211
PCT Pub. Date: Feb. 6, 2020

(65) Prior Publication Data

US 2021/0301378 A1 Sep. 30, 2021

(30) Foreign Application Priority Data

Aug. 3, 2018 (JP) ..... 2018-147100

(51) Int. Cl.
*C22C 38/28* (2006.01)
*C21D 8/02* (2006.01)
(Continued)

(52) U.S. Cl.
CPC ..... *C22C 38/38* (2013.01); *C21D 8/0226* (2013.01); *C21D 8/0263* (2013.01);
(Continued)

(58) Field of Classification Search
None
See application file for complete search history.

(56) References Cited

U.S. PATENT DOCUMENTS 7,708,841 B2 5/2010 Saller et al.
10,092,751 B2 10/2018 Moon
(Continued)

FOREIGN PATENT DOCUMENTS

CN 102822371 A 12/2012
CN 107177786 A 9/2017
(Continued)

OTHER PUBLICATIONS

Feb. 21, 2020, Office Action issued by the Taiwan Intellectual Property Office in the corresponding Taiwanese Patent Application No. 108127596 with English language Concise Statement of Relevance.

(Continued)

*Primary Examiner* — Anthony M Liang
(74) *Attorney, Agent, or Firm* — KENJA IP LAW PC

(57) ABSTRACT

Provided is a high-Mn steel having excellent low-temperature toughness and excellent surface characteristics. A high-Mn steel comprises: a chemical composition containing, in mass %, C: 0.100 to 0.700%, Si: 0.05 to 1.00%, Mn: 20.0 to 35.0%, P: ≤0.030%, S: ≤0.0070%, Al: 0.010 to 0.070%, Cr: 0.50 to 5.00%, N: 0.0050 to 0.0500%, O: ≤0.0050%, Ti: ≤0.005%, and Nb: ≤0.005%, with a balance consisting of Fe and inevitable impurities; and a microstructure having austenite as a matrix, wherein in the microstructure, a Mn concentration of a Mn-concentrated portion is 38.0% or less, and an average KAM value is 0.3 or more, yield stress is 400 MPa or more, absorbed energy $vE_{-196}$ in a Charpy impact test at −196° C. is 100 J or more, and percent brittle fracture is less than 10%.

3 Claims, 1 Drawing Sheet

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/26*** | (2006.01) |
| ***C22C 38/38*** | (2006.01) |

(52) U.S. Cl.
CPC ..... *C22C 38/001* (2013.01); *C22C 38/002* (2013.01); *C22C 38/02* (2013.01); *C22C 38/06* (2013.01); *C22C 38/26* (2013.01); *C22C 38/28* (2013.01); *C21D 2211/001* (2013.01)

(56) References Cited

U.S. PATENT DOCUMENTS

| | | | |
|---|---|---|---|
| 2016/0319407 | A1 | 11/2016 | Lee et al. |
| 2019/0323108 | A1 | 10/2019 | Bae |

FOREIGN PATENT DOCUMENTS

| | | | | |
|---|---|---|---|---|
| CN | 110050082 | A | | 7/2019 |
| EP | 2554699 | B1 | | 8/2016 |
| EP | 3553195 | A1 | | 10/2019 |
| EP | 3677700 | A1 | | 7/2020 |
| EP | 3553195 | B1 | | 5/2021 |
| ES | 2280936 | T3 | | 9/2007 |
| JP | S5623259 | A | | 3/1981 |
| JP | S62270721 | A | | 11/1987 |
| JP | 2007126715 | A | * | 5/2007 |
| JP | 2007126715 | A | | 5/2007 |
| JP | 2016196703 | A | | 11/2016 |
| JP | 2017502749 | A | | 1/2017 |
| JP | 2017155300 | A | | 9/2017 |
| KR | 1020150075315 | A | | 7/2015 |
| KR | 1020160078664 | A | | 7/2016 |
| KR | 1020180074450 | A | | 7/2018 |
| WO | 2018104984 | A1 | | 6/2018 |
| WO | 2018105510 | A1 | | 6/2018 |
| WO | 2018117712 | A1 | | 6/2018 |
| WO | 2019044928 | A1 | | 3/2019 |

OTHER PUBLICATIONS

Jun. 24, 2020, Office Action issued by the Taiwan Intellectual Property Office in the corresponding Taiwanese Patent Application No. 108127596 with English language Concise Statement of Relevance.

Oct. 29, 2019, International Search Report issued in the International Patent Application No. PCT/JP2019/030051.

Jul. 14, 2022, Office Action issued by the Korean Intellectual Property Office in the corresponding Korean Patent Application No. 10-2021-7002852 with English language concise statement of relevance.

Sep. 1, 2022, Office Action issued by the China National Intellectual Property Administration in the corresponding Chinese Patent Application No. 201980050484.1 with English language concise statement of relevance.

Aug. 23, 2021, Office Action issued by the China National Intellectual Property Administration in the corresponding Chinese Patent Application No. 201980050484.1 with English language search report.

Tingpu Wang et al., Modern Steel Rolling Science, 2014, pp. 126-127, Metallurgical Industry Press with a partial English translation.

Jun. 18, 2021, the Extended European Search Report issued by the European Patent Office in the corresponding European Patent Application No. 19843919.2.

Jan. 13, 2022, Office Action issued by the China National Intellectual Property Administration in the corresponding Chinese Patent Application No. 201980050484.1 with English language concise statement of relevance.

* cited by examiner

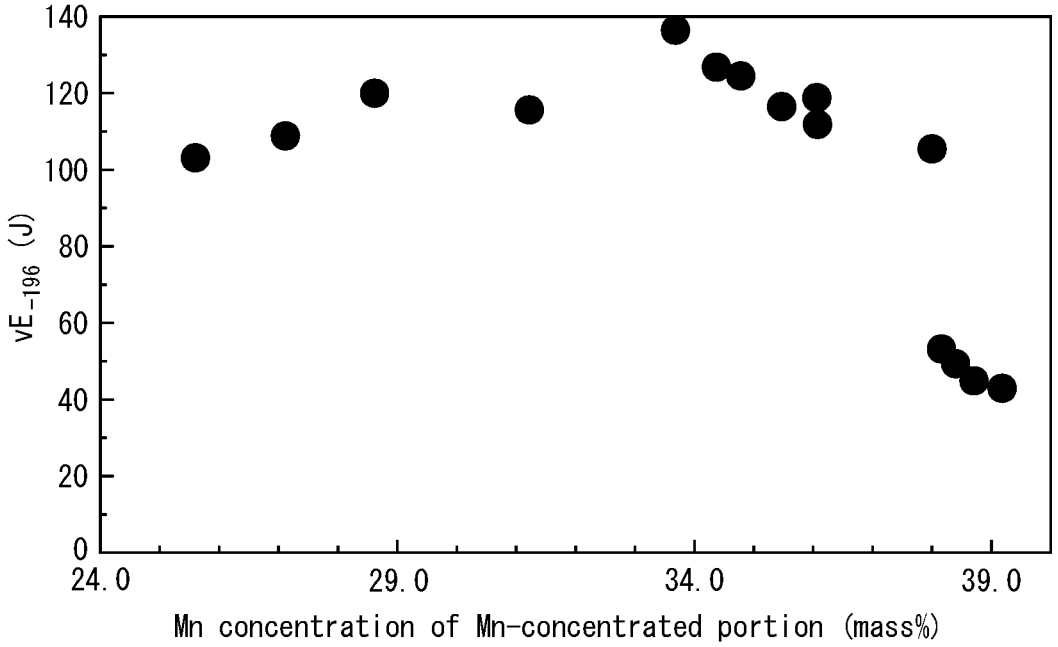
140
120
100
80
60
40
20
0
vE-196 (J)
24.0
29.0
34.0
39.0
Mn concentration of Mn-concentrated portion (mass%)

HIGH-MN STEEL AND METHOD OF PRODUCING SAME

TECHNICAL FIELD

The present disclosure relates to a high-Mn steel having excellent toughness particularly at low temperatures and suitable for structural steel used in very-low-temperature environments such as liquefied gas storage tanks, and a method of producing the same.

BACKGROUND

Operating environments of structures such as liquefied gas storage tanks reach very low temperatures, and thus hot-rolled steel plates used for such structures are required to have excellent toughness at very low temperatures as well as excellent strength. For example, a hot-rolled steel plate used for a liquefied natural gas storage needs to have excellent toughness in a temperature range lower than −164° C. which is the boiling point of liquefied natural gas. If the low-temperature toughness of the steel plate used for the very-low-temperature storage structure is insufficient, the safety of the very-low-temperature storage structure is likely to be undermined. There is thus strong need to improve the low-temperature toughness of the steel plate used.

In response to this need, austenitic stainless steel having, as steel plate microstructure, austenite which is not embrittled at very low temperatures, 9% Ni steel, and 5000 series aluminum alloys are conventionally used. However, due to high alloy costs or production costs of these materials, there is demand for a steel material that is inexpensive and has excellent low-temperature toughness.

A structure such as a liquefied gas storage tank needs to be coated in order to prevent the steel plate from rust and corrosion. It is important to achieve aesthetic appearance after the coating, for environmental harmony. Hence, the hot-rolled steel plate used for a liquefied natural gas storage is also required to have excellent characteristics of the steel plate surface as the base of the coating. That is, the roughness of the steel plate surface needs to be low.

In view of this, for example, JP 2017-507249 A (PTL 1) proposes use of, as a new steel material to replace conventional steels for very low temperature use, a high-Mn steel containing a large amount of Mn which is a relatively inexpensive austenite-stabilizing element, for structural steel in very-low-temperature environments. The technique proposed in PTL 1 involves controlling stacking fault energy to achieve excellent low-temperature toughness without surface unevenness.

CITATION LIST

Patent Literature

PTL 1: JP 2017-507249 A

SUMMARY

Technical Problem

With the technique described in PTL 1, a high-Mn steel with excellent surface quality can be provided without surface unevenness after working such as tensile working. However, PTL 1 does not mention about the surface roughness of a hot-rolled steel plate produced. The produced hot-rolled steel plate is usually shipped after its surface is made uniform by shot blasting treatment. In the case where the steel plate surface after the shot blasting treatment is rough, local rusting occurs. To prevent this, the surface characteristics need to be adjusted by a grinder or the like. This causes a decrease in productivity.

It could therefore be helpful to provide a high-Mn steel having excellent low-temperature toughness and excellent surface characteristics. It could also be helpful to provide an advantageous method of producing the high-Mn steel. Herein, "excellent low-temperature toughness" means that the absorbed energy $vE_{-196}$ in the Charpy impact test at −196° C. is 100 J or more and the percent brittle fracture is less than 10%, and "excellent surface characteristics" mean that the surface roughness Ra after typical shot blasting treatment is 200 μm or less.

Solution to Problem

We conducted intensive studies on various factors that determine the chemical composition and microstructure of a steel plate for high-Mn steel, and discovered the following a to d:

a. If a Mn-concentrated portion with a Mn concentration of more than 38.0 mass % forms in austenitic steel having high Mn content, the percent brittle fracture reaches 10% or more at low temperatures, and the low-temperature toughness decreases. Accordingly, an effective way of improving the low-temperature toughness of high-Mn steel is to limit the Mn concentration of the Mn-concentrated portion to 38.0 mass % or less.

b. If austenitic steel having high Mn content contains Cr in an amount of more than 5.00 mass %, descaling during hot rolling is insufficient. This causes the hot-rolled sheet after shot blasting treatment to have a rough surface with surface roughness Ra of more than 200 μm. Hence, the Cr content needs to be 5.00 mass % or less, for improvement in the surface characteristics of the high-Mn steel.

c. By performing hot rolling and descaling under appropriate conditions, the foregoing a and b can be achieved without an increase in production costs.

d. By performing hot rolling under appropriate conditions to provide high dislocation density, yield stress can be effectively increased.

The present disclosure is based on these discoveries and further studies. We thus provide:

1. A high-Mn steel comprising: a chemical composition containing (consisting of), in mass %, C: 0.100% or more and 0.700% or less, Si: 0.05% or more and 1.00% or less, Mn: 20.0% or more and 35.0% or less, P: 0.030% or less, S: 0.0070% or less, Al: 0.010% or more and 0.070% or less, Cr: 0.50% or more and 5.00% or less, N: 0.0050% or more and 0.0500% or less, O: 0.0050% or less, Ti: 0.005% or less, and Nb: 0.005% or less, with a balance consisting of Fe and inevitable impurities; and a microstructure having austenite as a matrix, wherein in the microstructure, a Mn concentration of a Mn-concentrated portion is 38.0 mass % or less, and an average of Kernel Average Misorientation (KAM) value is 0.3 or more, yield stress is 400 MPa or more, absorbed energy $vE_{-196}$ in a Charpy impact test at −196° C. is 100 J or more, and percent brittle fracture is less than 10%.

2. The high-Mn steel according to 1., wherein the chemical composition further contains, in mass %, one or more selected from Cu: 0.01% or more and 0.50% or less, Mo: 2.00% or less, V: 2.00% or less, and W: 2.00% or less.

3. The high-Mn steel according to 1. or 2., wherein the chemical composition further contains, in mass %, one or more selected from Ca: 0.0005% or more and 0.0050% or less, Mg: 0.0005% or more and 0.0050% or less, and REM: 0.0010% or more and 0.0200% or less.

4. A method of producing a high-Mn steel, the method comprising: heating a steel raw material having the chemical composition according to any one of 1. to 3. to a temperature range of 1100° C. or more and 1300° C. or less; and thereafter subjecting the steel raw material to hot rolling with a rolling finish temperature of 800° C. or more and a total rolling reduction of 20% or more, and performing descaling treatment in the hot rolling.

Herein, the temperature range and the temperature are each the surface temperature of the steel raw material or steel plate.

5. A method of producing a high-Mn steel, the method comprising: heating a steel raw material having the chemical composition according to any one of 1. to 3. to a temperature range of 1100° C. or more and 1300° C. or less; thereafter subjecting the steel raw material to first hot rolling with a rolling finish temperature of 1100° C. or more and a total rolling reduction of 20% or more; and thereafter subjecting the hot-rolled steel raw material to second hot rolling with a rolling finish temperature of 700° C. or more and less than 950° C., and performing descaling treatment in the second hot rolling.

6. A method of producing a high-Mn steel, the method comprising: heating a steel raw material having the chemical composition according to any one of 1. to 3. to a temperature range of 1100° C. or more and 1300° C. or less; thereafter subjecting the steel raw material to first hot rolling with a rolling finish temperature of 800° C. or more and less than 1100° C. and a total rolling reduction of 20% or more; thereafter reheating the hot-rolled steel raw material to 1100° C. or more and 1300° C. or less; and thereafter subjecting the hot-rolled steel raw material to second hot rolling with a rolling finish temperature of 700° C. or more and less than 950° C., and performing descaling treatment in the second hot rolling.

7. The method of producing a high-Mn steel according to 5. or 6., wherein descaling treatment is performed in the first hot rolling.

8. The method of producing a high-Mn steel according to any one of 4. to 7., comprising performing cooling treatment, after final hot rolling, at an average cooling rate of 1.0° C./s or higher in a temperature range from a temperature of or higher than 100° C. below the rolling finish temperature to a temperature of 300° C. or more and 650° C. or less.

Advantageous Effect

It is thus possible to provide a high-Mn steel having excellent low-temperature toughness and excellent surface characteristics. The presently disclosed high-Mn steel significantly contributes to improved safety and life of steel structures used in very-low-temperature environments such as liquefied gas storage tanks. This yields significantly advantageous effects in industrial terms. The presently disclosed production method has excellent economic efficiency because it does not cause a decrease in productivity and an increase in production costs.

BRIEF DESCRIPTION OF THE DRAWINGS

In the accompanying drawings:

FIG. 1 is a graph illustrating results of measuring the Mn concentration of a Mn-concentrated portion and the absorbed energy in the Charpy impact test at −196° C.

DETAILED DESCRIPTION

A high-Mn steel according to one of the disclosed embodiments will be described in detail below.

[Chemical Composition]

First, the chemical composition of the high-Mn steel according to one of the disclosed embodiments and the reasons for limiting the chemical composition will be described below. Herein, "%" used with regard to the chemical composition denotes "mass %" unless otherwise specified.

C: 0.100% or More and 0.700% or Less

C is an inexpensive austenite-stabilizing element, and is important in obtaining austenite. To achieve the effects, the C content needs to be 0.100% or more. If the C content is more than 0.700%, Cr carbides form excessively, and the low-temperature toughness decreases. The C content is therefore 0.100% or more and 0.700% or less. The C content is preferably 0.200% or more and 0.600% or less.

Si: 0.05% or More and 1.00% or Less

Si acts as a deoxidizer, and not only is necessary for steelmaking but also has an effect of strengthening the steel plate through solid solution strengthening by dissolving in the steel. To achieve the effects, the Si content needs to be 0.05% or more. If the Si content is more than 1.00%, the low-temperature toughness and the weldability decrease. The Si content is therefore 0.05% or more and 1.00% or less. The Si content is preferably 0.07% or more and 0.50% or less.

Mn: 20.0% or More and 35.0% or Less Mn is a relatively inexpensive austenite-stabilizing element. In the present disclosure, Mn is an important element for achieving both the strength and the low-temperature toughness. To achieve the effects, the Mn content needs to be 20.0% or more. If the Mn content is more than 35.0%, the low-temperature toughness decreases. The Mn content is therefore 20.0% or more and 35.0% or less. The Mn content is preferably 23.0% or more and 32.0% or less.

P: 0.030% or Less

If the P content is more than 0.030%, the low-temperature toughness decreases. Moreover, P segregates to grain boundaries and forms a stress corrosion cracking initiation point. It is therefore desirable to reduce the P content as much as possible, with its upper limit being set to 0.030%. The P content is therefore 0.030% or less. Excessive reduction of P is economically disadvantageous because the refining costs increase, and accordingly it is desirable to set the P content to 0.002% or more. The P content is preferably 0.005% or more and 0.028% or less, and further preferably 0.024% or less.

S: 0.0070% or Less

S decreases the low-temperature toughness and the ductility of the base metal. It is therefore desirable to reduce the S content as much as possible, with its upper limit being set to 0.0070%. The S content is therefore 0.0070% or less. Excessive reduction of S is economically disadvantageous because the refining costs increase, and accordingly it is desirable to set the S content to 0.0010% or more. The S content is preferably 0.0020% or more and 0.0060% or less.

Al: 0.010% or More and 0.070% or Less

Al acts as a deoxidizer, and is most generally used in the molten steel deoxidation process for steel plates. To achieve the effects, the Al content needs to be 0.010% or more. If the Al content is more than 0.070%, Al is mixed into a weld metal portion during welding and decreases the toughness of the weld metal. The Al content is therefore 0.070% or less. The Al content is preferably 0.020% or more and 0.060% or less.

Cr: 0.50% or More and 5.00% or Less

Cr is an element that, when added in an appropriate amount, stabilizes austenite and effectively improves the low-temperature toughness and the base metal strength. To achieve the effects, the Cr content needs to be 0.50% or more. If the Cr content is more than 5.00%, Cr carbides form, as a result of which the low-temperature toughness and the stress corrosion cracking resistance decrease. In addition, descaling during hot rolling is insufficient, and the surface roughness worsens. The Cr content is therefore 0.50% or more and 5.00% or less. The Cr content is preferably 0.60% or more and 4.00% or less, and more preferably 0.70% or more and 3.50% or less. In particular, to improve the stress corrosion cracking resistance, the Cr content is preferably 2.00% or more, and further preferably more than 2.70%.

N: 0.0050% or More and 0.0500% or Less

N is an austenite-stabilizing element, and is effective in improving the low-temperature toughness. To achieve the effects, the N content needs to be 0.0050% or more. If the N content is more than 0.0500%, nitrides or carbonitrides coarsen, and the toughness decreases. The N content is therefore 0.0050% or more and 0.0500% or less. The N content is preferably 0.0060% or more and 0.0400% or less.

O: 0.0050% or Less

O forms oxides and causes a decrease in low-temperature toughness. The O content is therefore 0.0050% or less. The O content is preferably 0.0045% or less. Although no lower limit is placed on the O content, excessive reduction of O is economically disadvantageous because the refining costs increase, and accordingly the O content is preferably 0.0010% or more.

Each of Ti and Nb: 0.005% or Less

Ti and Nb each form carbonitrides of a high melting point in the steel and suppress coarsening of crystal grains, and as a result form a fracture origin or a crack propagation path. Particularly in high-Mn steel, Ti and Nb hinder microstructure control for enhancing the low-temperature toughness and improving the ductility. Hence, Ti and Nb need to be reduced intentionally. In detail, Ti and Nb are components that are inevitably mixed in from raw material and the like, and usually Ti and Nb are each mixed in within a range of more than 0.005% and 0.010% or less. It is necessary to prevent inevitable mixing of Ti and Nb as much as possible by the below-described method or the like, to limit each of the Ti content and the Nb content to 0.005% or less. As a result of the Ti content and the Nb content each being limited to 0.005% or less, the foregoing adverse effect of carbonitrides can be avoided and excellent low-temperature toughness and excellent ductility can be ensured. The Ti content and the Nb content are each preferably 0.003% or less.

The Ti content and the Nb content may each be reduced to 0%. This is, however, economically disadvantageous because the load in steelmaking increases. From the viewpoint of economic efficiency, the Ti content and the Nb content are each desirably 0.001% or more.

The balance other then the components described above consists of iron and inevitable impurities. The inevitable impurities include, for example, H, B, and the like, and an allowable total amount of inevitable impurities is 0.01% or less.

The chemical composition of the high-Mn steel according to one of the disclosed embodiments may optionally contain the following elements in addition to the above-described essential elements, for the purpose of further improving the strength and the low-temperature toughness.

One or More Selected from Cu: 0.01% or More and 0.50% or Less, Mo: 2.00% or Less, V: 2.00% or Less, and W: 2.00% or Less Cu is an element that not only strengthens the steel plate by solid solution strengthening but also improves the dislocation mobility and improves the low-temperature toughness. To achieve the effects, the Cu content is preferably 0.01% or more. If the Cu content is more than 0.50%, the surface characteristics degrade in rolling. The Cu content is therefore preferably 0.01% or more and 0.50% or less. The Cu content is more preferably 0.02% or more and 0.40% or less. The Cu content is further preferably less than 0.20%.

Mo, V, and W contribute to stabilized austenite, and also contribute to improved base metal strength. To achieve the effects, the Mo content, the V content, and the W content are each preferably 0.001% or more. If the Mo content, the V content, and the W content are each more than 2.00%, coarse carbonitrides may form and serve as a fracture origin. In addition, the production costs increase. Accordingly, in the case of containing each of these alloy elements, the content is preferably 2.00% or less. The content is more preferably 0.003% or more and 1.70% or less, and further preferably 1.50% or less.

One or More Selected from Ca: 0.0005% or More and 0.0050% or Less, Mg: 0.0005% or More and 0.0050% or Less, and REM: 0.0010% or More and 0.0200% or Less Ca, Mg, and REM are each an element useful for morphological control of inclusions, and may be optionally contained. Morphological control of inclusions means turning elongated sulfide-based inclusions into granular inclusions. Through such morphological control of inclusions, the ductility, the toughness, and the sulfide stress corrosion cracking resistance are improved. To achieve the effects, the Ca content and the Mg content are each preferably 0.0005% or more, and the REM content is preferably 0.0010% or more. If the Ca content, the Mg content, and the REM content are each high, the amount of nonmetallic inclusions increase, which may decrease the ductility, the toughness, and the sulfide stress corrosion cracking resistance. Moreover, high contents of these elements are likely to be economically disadvantageous.

Accordingly, in the case of containing Ca and Mg, the Ca content and the Mg content are each preferably 0.0005% or more and 0.0050% or less. In the case of containing REM, the REM content is preferably 0.0010% or more and 0.0200% or less. More preferably, the Ca content is 0.0010% or more and 0.0040% or less, the Mg content is 0.0010% or more and 0.0040% or less, and the REM content is 0.0020% or more and 0.0150% or less.

[Microstructure]

Microstructure Having Austenite as Matrix

In the case where the crystal structure of the steel material is a body-centered cubic structure (bcc), there is a possibility that the steel material undergoes brittle fracture in a low-temperature environment. Such steel material is not suitable for use in a low-temperature environment. Assuming use in a low-temperature environment, it is essential that the crystal structure of the matrix of the steel material is austenite microstructure which is a face-centered cubic structure (fcc). The expression "having austenite as a matrix" means that austenite phase is 90% or more in area ratio. The remaining phase other than austenite phase is ferrite phase and/or martensite phase. The area ratio of austenite phase is further preferably 95% or more. The area ratio of austenite phase may be 100%.

Mn Concentration of Mn-Concentrated Portion in Microstructure: 38.0 Mass % or Less A hot-rolled steel plate obtained by hot rolling the steel raw material having the foregoing chemical composition inevitably has a Mn-concentrated portion. The "Mn-concentrated portion" is a portion whose Mn concentration is highest in a micro segregation area. When the steel raw material containing Mn is hot rolled, segregated band of Mn occurs, as a result of which the Mn-concentrated portion forms inevitably.

FIG. 1 illustrates results of measuring the Mn concentration of the Mn-concentrated portion and the absorbed energy in the Charpy impact test at −196° C. for each steel plate obtained by hot rolling the steel raw material having the foregoing chemical composition under various conditions. As illustrated in the drawing, as a result of hot rolling the steel raw material having the foregoing chemical composition under appropriate conditions and limiting the Mn concentration of the Mn-concentrated portion to 38.0 mass % or less, absorbed energy of 100 J or more can be achieved. The Mn concentration of the Mn-concentrated portion is preferably 37.0 mass % or less.

Although no lower limit is placed on the Mn concentration of the Mn-concentrated portion, the Mn concentration of the Mn-concentrated portion is preferably 25.0 mass % or more in order to ensure the stability of austenite.

Average of Kernel Average Misorientation (KAM) value: 0.3 or more A KAM value is obtained as follows: At each of depth positions of ¼ and ½ of the thickness from the surface of the steel plate after hot rolling, electron backscatter diffraction (EBSD) analysis is performed for any two observation fields of 500 μm×200 μm. And, from the analysis results, the average value of misorientations (orientation differences) between each pixel and its adjacent pixels within a crystal grain is calculated as the KAM value. The KAM value reflects local crystal orientation changes by dislocations in the microstructure. A higher KAM value indicates greater misorientations between the measurement point and its adjacent parts. That is, a higher KAM value indicates a higher degree of local deformation within the grain. Hence, when the KAM value in the steel plate after the rolling is higher, the dislocation density is higher. If the average KAM value is 0.3 or more, a lot of dislocations are accumulated, so that the yield stress is improved. The average KAM value is preferably 0.5 or more. If the average KAM value is more than 1.3, the toughness is likely to decrease. Accordingly, the average KAM value is preferably 1.3 or less.

The hot-rolled sheet that has the foregoing chemical composition and in which the Mn concentration of the Mn-concentrated portion is 38.0% or less and the average KAM value is 0.3 or more has, as a result of being subjected to descaling at least in final hot rolling, surface roughness Ra of 200 μm or less after shot blasting treatment is performed by a typical method. This is because, as a result of performing descaling, an increase in surface roughness caused by scale biting during rolling is suppressed and cooling unevenness caused by scale during cooling is suppressed, and the material surface hardness is made uniform to thus suppress an increase in surface roughness during shot blasting.

If the surface roughness Ra after the shot blasting is more than 200 μm, not only the aesthetic appearance after the coating is impaired, but also local corrosion progresses in recessed parts. Hence, the surface roughness Ra needs to be 200 μm or less. The surface roughness Ra is preferably 150 μm or less, and more preferably 120 μm or less. Although no lower limit is placed on the surface roughness Ra, the surface roughness Ra is preferably 5 μm or more in order to avoid an increase in mending costs.

Mn forms oxides that diffuse from inside the steel to the steel plate surface to precipitate and concentrate on the steel plate surface. Such oxides are called concentrated substances on surface. Accordingly, by limiting the Mn concentration of the Mn-concentrated portion to 38.0% or less, surface roughness Ra of 200 μm or less can be achieved.

For the high-Mn steel according to one of the disclosed embodiments, molten steel having the foregoing chemical composition may be obtained by steelmaking according to a well-known steelmaking method using a converter, an electric heating furnace, or the like. Secondary refining may be performed in a vacuum degassing furnace. In this case, it is necessary to limit Ti and Nb, which hinder suitable microstructure control, to the foregoing range, by preventing Ti and Nb from being inevitably mixed in from raw material and the like and reducing their contents. For example, by decreasing the basicity of slag in the refining stage, alloys of Ti and Nb are concentrated in the slag and discharged, thus reducing the concentrations of Ti and Nb in the final slab product. Alternatively, a method of blowing in oxygen to cause oxidation and, during circulation, inducing floatation separation of alloys of Ti and Nb may be used. Subsequently, a steel raw material such as a slab with predetermined dimensions is preferably obtained by a well-known casting method such as continuous casting.

Further, to make the steel raw material into a steel material having excellent low-temperature toughness, the steel raw material is heated to a temperature range of 1100° C. or more and 1300° C. or less, and then subjected to hot rolling with a rolling finish temperature of 800° C. or more and a total rolling reduction of 20% or more and subjected to descaling treatment in the hot rolling. Each of the processes will be described below.

[Steel Raw Material Heating Temperature: 1100° C. or More and 1300° C. or Less]

To obtain the high-Mn steel having the foregoing structure, it is important to heat the steel raw material to a temperature range of 1100° C. or more and 1300° C. or less and subject the steel raw material to hot rolling with a rolling finish temperature of 800° C. or more and a total rolling reduction of 20% or more. Here, the temperature control is based on the surface temperature of the steel raw material.

In detail, to facilitate diffusion of Mn in the hot rolling, the heating temperature before the rolling is set to 1100° C. or more. If the heating temperature is more than 1300° C., there is a possibility that the steel starts to melt. The upper limit of the heating temperature is therefore 1300° C. The heating temperature is preferably 1150° C. or more and 1250° C. or less.

[Hot Rolling: Rolling Finish Temperature of 800° C. or More and Total Rolling Reduction of 20% or More]

Next, in the hot rolling, it is important to set a high total rolling reduction of 20% or more at the end of rolling, to reduce the distance between the Mn-concentrated portion and the Mn-dilute portion and facilitate diffusion of Mn. The total rolling reduction is preferably 30% or more. Although no upper limit is placed on the total rolling reduction, the total rolling reduction is preferably 98% or less from the viewpoint of improving the rolling efficiency. The total rolling reduction herein refers to each of the rolling reduction with respect to the thickness of the slab on the entry side of the first hot rolling at the end of the first hot rolling, and the rolling reduction with respect to the thickness of the slab on the entry side of the second hot rolling at the end of the second hot rolling. In the case where hot rolling is performed twice, it is preferable that the total rolling reduction is 20% or more at the end of the first hot rolling and 50% or more at the end of the second hot rolling. In the case where hot rolling is performed only once, it is preferable that the total rolling reduction is 60% or more.

Likewise, the rolling finish temperature is set to 800° C. or more, from the viewpoint of facilitating diffusion of Mn during the rolling and ensuring the low-temperature toughness. If the rolling finish temperature is less than 800° C., the rolling finish temperature is well below ⅔ of the melting point (1246° C.) of Mn, so that Mn cannot be diffused sufficiently. We learned from our studies that Mn can be diffused sufficiently if the rolling finish temperature is 800° C. or more. We consider that, because the Mn diffusion coefficient in austenite is low, rolling in a temperature range of 800° C. or more is necessary for sufficient diffusion of Mn. The rolling finish temperature is preferably 950° C. or more, and further preferably 1000° C. or more. The rolling finish temperature is preferably 1050° C. or less, from the viewpoint of ensuring the strength.

After the foregoing hot rolling, the second hot rolling satisfying the following conditions may be optionally performed to effectively facilitate diffusion of Mn. In this case, if the finish temperature of the foregoing first hot rolling is 1100° C. or more, the second hot rolling is performed directly after the first hot rolling. If the finish temperature of the first hot rolling is less than 1100° C., on the other hand, reheating to 1100° C. or more is performed. If the reheating temperature is more than 1300° C., there is a possibility that the steel starts to melt, as in the foregoing heating. The upper limit of the reheating temperature is therefore 1300° C. Here, the temperature control is based on the surface temperature of the steel raw material.

[Second Hot Rolling: Rolling Finish Temperature: 700° C. or More and Less than 950° C.]

In the second hot rolling, it is necessary to perform at least one or more passes in a temperature range of 700° C. or more and less than 950° C. As a result of performing one or more passes of rolling at less than 950° C. with a rolling ratio of preferably 10% or more per pass, dislocations introduced in the first rolling tend unlikely to recover, thereby likely to remain, with it being possible to further increase the KAM value. If the rolling finish temperature in the second hot rolling is 950° C. or more, crystal grains become excessively coarse, and the desired yield stress cannot be obtained. Hence, finish rolling of one or more passes is performed at less than 950° C. The rolling finish temperature is preferably 900° C. or less, and more preferably 850° C. or less.

If the rolling finish temperature is less than 700° C., the toughness decreases. The rolling finish temperature is therefore 700° C. or more. The rolling finish temperature is preferably 750° C. or more. The total rolling reduction at the end of the second hot rolling is preferably 20% or more, and more preferably 50% or more. If the total rolling reduction is more than 95%, the toughness decreases. Accordingly, the total rolling reduction at the end of the second hot rolling is preferably 95% or less. Herein, the total rolling reduction at the end of the second hot rolling is a value calculated using the thickness before the second hot rolling and the thickness after the second hot rolling.

Moreover, by performing descaling treatment once or more in the hot rolling, a steel plate having excellent surface characteristics can be produced. The descaling treatment is preferably performed twice or more, and more preferably performed three times or more. Although no upper limit is placed on the number of times the descaling treatment is performed, the number of times the descaling treatment is performed is preferably 20 or less from the operational viewpoint. The descaling treatment is preferably performed before the first pass of the hot rolling. In the case where the hot rolling is performed once, the descaling treatment is performed in the hot rolling. In the case where the hot rolling is performed twice, the descaling treatment is performed at least in the second hot rolling. In the case where the hot rolling is performed twice, it is more preferable to perform the descaling treatment both in the first hot rolling and in the second hot rolling.

Next, cooling treatment according to the following conditions is preferably performed. In the case where the hot rolling is performed twice, the cooling treatment is performed after the hot rolling. In the case where the hot rolling is performed twice, the cooling treatment is performed after the second hot rolling.

[Cooling rate in temperature range from temperature not less than (rolling finish temperature−100° C.) to temperature of 300° C. or more and 650° C. or less: 1.0° C./s or higher]

After the hot rolling ends, it is preferable to perform cooling rapidly. If the steel plate after the hot rolling is cooled slowly, the formation of precipitates is promoted, which is likely to cause a decrease in low-temperature toughness. Such precipitate formation can be suppressed by cooling at a cooling rate of 1.0° C./s or higher in a temperature range from a temperature not less than (rolling finish temperature−100° C.) to a temperature of 300° C. or more and 650° C. or less (in other words, to a temperature between 300 to 650° C.). The reason for limiting the cooling rate in the temperature range from a temperature not less than (rolling finish temperature−100° C.) to a temperature of 300° C. or more and 650° C. or less is because this temperature range corresponds to the carbide precipitation temperature range. Excessive cooling strains the steel plate, and causes a decrease in productivity. Particularly in the case where the thickness of the steel material is 10 mm or less, air cooling is preferable. Accordingly, the upper limit of the cooling start temperature is preferably 900° C.

If the average cooling rate in the foregoing temperature range is less than 1.0° C./s, precipitate formation is likely to be promoted. The average cooling rate is therefore preferably 1.0° C./s or more. From the viewpoint of preventing strain of the steel plate due to excessive cooling, the average cooling rate is preferably 15.0° C./s or less. Particularly in the case where the thickness of the steel material is 10 mm or less, the average cooling rate is preferably 5.0° C./s or less, and further preferably 3.0° C./s or less.

The hot-rolled steel plate produced as a result of the processes described above has a Mn-concentrated portion of low Mn concentration as hot rolled, and thus need not be heat-treated subsequently.

Examples

The presently disclosed techniques will be described in more detail below by way of examples. The presently disclosed techniques are not limited to the examples described below.

Steel slabs having the chemical compositions indicated in Table 1 were produced in a process for refining with converter and ladle and continuous casting. Each obtained steel slab was then subjected to hot rolling under the conditions indicated in Table 2, to obtain a steel plate of 6 mm to 30 mm in thickness. For each obtained steel plate, the tensile property, the toughness, and the microstructure were evaluated as follows.

(1) Tensile Test Property

A JIS No. 5 tensile test piece was collected from each obtained steel plate, and a tensile test was performed in accordance with JIS Z 2241 (1998) to examine the tensile test property. In the case where the yield stress was 400 MPa or more and the tensile strength was 800 MPa or more, the sample was determined to have excellent tensile property. In the case where the elongation was 40% or more, the sample was determined to have excellent ductility.

(2) Low-Temperature Toughness

At a position of ¼ of the thickness from the surface of each steel plate of more than 20 mm in thickness and at a position of ½ of the thickness from the surface of each steel plate of 10 mm or more and 20 mm or less in thickness, three V-notch Charpy test pieces were collected in the rolling direction in accordance with JIS Z 2202 (1998) and subjected to the Charpy impact test in accordance with JIS Z 2242 (1998) to determine the absorbed energy at −196° C. and evaluate the base metal toughness. For each steel plate of less than 10 mm in thickness, three 5 mm subsize V-notch Charpy test pieces were collected and subjected to the Charpy impact test in accordance with the foregoing JIS standards, to determine the absorbed energy at −196° C. The determined value was then multiplied by 1.5 to evaluate the base metal toughness. In the case where the average value of the absorbed energies ($vE_{-196}$) of the three test pieces was 100 J or more, the sample was determined to have excellent base metal toughness. This is because brittle fracture may be included if the average absorbed energy is less than 100 J.

(3) Microstructure Evaluation

KAM Value

At each of positions of ¼ and ½ of the thickness on a polished surface of a cross-section in the rolling direction of each steel plate after the hot rolling, electron backscatter diffraction (EBSD) analysis (measurement step: 0.3 μm) was performed for any two observation fields of 500 μm×200 μm using scanning electron microscope (SEM) JSM-7001F produced by JEOL Ltd. From the analysis results, the average value of misorientations (orientation differences) between each pixel and its adjacent pixels within a crystal grain was calculated, and the average value of the calculated average values over the whole measurement region was taken to be the average KAM value.

Mn Concentration of Mn-Concentrated Portion

Further, electron probe micro analyzer (EPMA) analysis was performed at each EBSD measurement position for the KAM value to determine the Mn concentration, and a portion having the highest Mn concentration was taken to be the concentrated portion.

Austenite Area Ratio

EBSD analysis (measurement step: 0.3 μm) was performed at each EBSD measurement position, and the austenite area ratio was measured from the resultant phase map.

Percent Brittle Fracture

After performing the Charpy impact test at −196° C., SEM observation (for 10 observation fields with 500 magnification) was performed, and the percent brittle fracture was measured.

Surface Roughness Ra

Each steel plate after the hot rolling was subjected to shot blasting treatment using a blast material having a Vickers hardness (HV) of 400 or more and a granularity of not less than ASTM Eli sieve No. 12. For the resultant steel plate surface, the reference length and the evaluation length were determined and the surface roughness Ra was measured in accordance with JIS B 0633. In the case where the surface roughness Ra was 200 μm or less, the sample was determined to have excellent surface characteristics.

These results are indicated in Table 3.

TABLE 1

| Steel | Chemical composition (mass %) | | | | | | | | | |
|---|---|---|---|---|---|---|---|---|---|---|
| No. | C | Si | Mn | P | S | Al | Cr | O | N | Nb |
| 1 | 0.230 | 0.66 | 32.2 | 0.020 | 0.0064 | 0.029 | 3.42 | 0.0040 | 0.0141 | 0.002 |
| 2 | 0.423 | 0.45 | 33.3 | 0.022 | 0.0035 | 0.048 | 0.74 | 0.0035 | 0.0095 | 0.002 |
| 3 | 0.531 | 0.12 | 24.3 | 0.018 | 0.0043 | 0.035 | 5.00 | 0.0027 | 0.0268 | 0.002 |
| 4 | 0.334 | 0.55 | 33.5 | 0.026 | 0.0042 | 0.051 | 0.63 | 0.0033 | 0.0319 | 0.001 |
| 5 | 0.456 | 0.30 | 31.5 | 0.025 | 0.0036 | 0.056 | 3.85 | 0.0016 | 0.0088 | 0.002 |
| 6 | 0.185 | 0.96 | 35.0 | 0.014 | 0.0016 | 0.040 | 0.50 | 0.0023 | 0.0152 | 0.001 |
| 7 | 0.610 | 0.08 | 23.6 | 0.016 | 0.0024 | 0.047 | 3.56 | 0.0034 | 0.0156 | 0.003 |
| 8 | 0.411 | 0.35 | 28.9 | 0.026 | 0.0036 | 0.029 | 2.71 | 0.0041 | 0.0427 | 0.002 |
| 9 | 0.513 | 0.31 | 32.4 | 0.019 | 0.0062 | 0.043 | 1.20 | 0.0025 | 0.0140 | 0.003 |
| 10 | 0.612 | 0.45 | 20.0 | 0.024 | 0.0045 | 0.039 | 4.56 | 0.0021 | 0.0102 | 0.002 |
| 11 | 0.704 | 0.85 | 34.1 | 0.023 | 0.0019 | 0.041 | 2.39 | 0.0022 | 0.0125 | 0.002 |
| 12 | 0.165 | 0.04 | 21.6 | 0.020 | 0.0038 | 0.047 | 3.77 | 0.0027 | 0.0310 | 0.002 |
| 13 | 0.184 | 0.45 | 35.4 | 0.024 | 0.0041 | 0.050 | 1.02 | 0.0044 | 0.0412 | 0.001 |
| 14 | 0.346 | 0.60 | 27.0 | 0.033 | 0.0065 | 0.053 | 0.89 | 0.0040 | 0.0238 | 0.003 |
| 15 | 0.378 | 0.36 | 22.6 | 0.018 | 0.0073 | 0.036 | 4.74 | 0.0025 | 0.0089 | 0.001 |
| 16 | 0.353 | 0.35 | 33.1 | 0.014 | 0.0055 | 0.049 | 3.55 | 0.0029 | 0.0184 | 0.001 |
| 17 | 0.634 | 0.62 | 20.7 | 0.025 | 0.0036 | 0.072 | 3.50 | 0.0037 | 0.0275 | 0.001 |
| 18 | 0.175 | 0.71 | 32.3 | 0.016 | 0.0035 | 0.042 | 5.08 | 0.0028 | 0.0189 | 0.002 |
| 19 | 0.610 | 0.48 | 30.1 | 0.022 | 0.0060 | 0.026 | 1.16 | 0.0052 | 0.0198 | 0.002 |
| 20 | 0.554 | 0.75 | 24.9 | 0.020 | 0.0021 | 0.043 | 0.97 | 0.0030 | 0.0541 | 0.002 |
| 21 | 0.096 | 0.31 | 21.5 | 0.022 | 0.0035 | 0.046 | 2.31 | 0.0019 | 0.0087 | 0.002 |
| 22 | 0.574 | 1.04 | 34.7 | 0.029 | 0.0037 | 0.030 | 4.63 | 0.0035 | 0.0157 | 0.002 |
| 23 | 0.733 | 0.64 | 21.8 | 0.019 | 0.0040 | 0.028 | 0.46 | 0.0033 | 0.0221 | 0.003 |
| 24 | 0.650 | 0.25 | 22.8 | 0.025 | 0.0062 | 0.047 | 3.42 | 0.0018 | 0.0413 | 0.006 |
| 25 | 0.106 | 0.47 | 23.4 | 0.013 | 0.0018 | 0.036 | 2.13 | 0.0015 | 0.0079 | 0.002 |
| 26 | 0.434 | 0.49 | 19.5 | 0.022 | 0.0045 | 0.047 | 0.64 | 0.0035 | 0.0416 | 0.002 |
| 27 | 0.190 | 0.93 | 20.2 | 0.025 | 0.0061 | 0.036 | 0.55 | 0.0040 | 0.0049 | 0.001 |
| 28 | 0.450 | 0.23 | 24.1 | 0.016 | 0.0037 | 0.038 | 4.94 | 0.0028 | 0.0142 | 0.001 |
| 29 | 0.351 | 0.52 | 34.6 | 0.019 | 0.0040 | 0.041 | 3.50 | 0.0018 | 0.0201 | 0.002 |
| 30 | 0.503 | 0.46 | 27.5 | 0.020 | 0.0053 | 0.052 | 2.51 | 0.0030 | 0.0184 | 0.001 |
| 31 | 0.701 | 0.35 | 22.2 | 0.021 | 0.0038 | 0.043 | 4.86 | 0.0035 | 0.0427 | 0.002 |
| 32 | 0.114 | 1.01 | 20.3 | 0.025 | 0.0045 | 0.029 | 1.13 | 0.0043 | 0.0132 | 0.002 |

TABLE 1-continued

| | | | | | | | | | | |
|---|---|---|---|---|---|---|---|---|---|---|
| 33 | 0.137 | 0.64 | 19.8 | 0.023 | 0.0029 | 0.035 | 0.55 | 0.0027 | 0.0238 | 0.001 |
| 34 | 0.669 | 0.78 | 31.8 | 0.024 | 0.0062 | 0.049 | 0.47 | 0.0039 | 0.0450 | 0.001 |
| 35 | 0.205 | 0.88 | 20.5 | 0.028 | 0.0065 | 0.068 | 4.87 | 0.0047 | 0.0504 | 0.001 |

| Steel | Chemical composition (mass %) | | | | | | | | |
|---|---|---|---|---|---|---|---|---|---|
| No. | Ti | Cu | V | Mo | W | Ca | Mg | REM | Remarks |
| 1 | 0.002 | 0.35 | — | — | — | — | — | — | Example |
| 2 | 0.002 | 0.24 | — | — | — | — | — | — | Example |
| 3 | 0.001 | 0.50 | 0.10 | — | — | — | — | — | Example |
| 4 | 0.003 | 0.28 | — | 0.51 | — | — | — | — | Example |
| 5 | 0.002 | 0.41 | — | — | 0.07 | — | — | — | Example |
| 6 | 0.001 | — | — | — | — | 0.0021 | — | — | Example |
| 7 | 0.003 | 0.13 | — | — | — | — | 0.0050 | — | Example |
| 8 | 0.002 | 0.27 | — | — | — | — | — | 0.0031 | Example |
| 9 | 0.003 | 0.42 | — | — | — | — | — | — | Example |
| 10 | 0.001 | 0.05 | — | — | — | — | — | — | Example |
| 11 | 0.002 | 0.37 | — | — | — | — | — | — | Comparative Example |
| 12 | 0.002 | 0.24 | — | — | — | — | — | — | Comparative Example |
| 13 | 0.002 | 0.45 | — | — | — | — | — | — | Comparative Example |
| 14 | 0.002 | 0.08 | — | — | — | — | — | — | Comparative Example |
| 15 | 0.002 | 0.31 | — | — | — | — | — | — | Comparative Example |
| 16 | 0.002 | 0.58 | — | — | — | — | — | — | Comparative Example |
| 17 | 0.003 | 0.18 | — | — | — | — | — | — | Comparative Example |
| 18 | 0.002 | 0.29 | — | — | — | — | — | — | Comparative Example |
| 19 | 0.002 | 0.36 | — | — | — | — | — | — | Comparative Example |
| 20 | 0.004 | 0.27 | — | — | — | — | — | — | Comparative Example |
| 21 | 0.002 | 0.15 | — | — | — | — | — | — | Comparative Example |
| 22 | 0.003 | 0.41 | — | — | — | — | — | — | Comparative Example |
| 23 | 0.001 | 0.20 | — | — | — | — | — | — | Comparative Example |
| 24 | 0.002 | 0.16 | — | — | — | — | — | — | Comparative Example |
| 25 | 0.006 | 0.38 | — | — | — | — | — | — | Comparative Example |
| 26 | 0.002 | 0.26 | — | — | — | — | — | — | Comparative Example |
| 27 | 0.001 | — | — | — | — | — | — | — | Comparative Example |
| 28 | 0.001 | — | — | — | — | — | — | — | Example |
| 29 | 0.001 | — | — | — | — | — | — | — | Example |
| 30 | 0.002 | — | — | — | — | — | — | — | Example |
| 31 | 0.002 | — | — | — | — | — | — | — | Comparative Example |
| 32 | 0.001 | — | — | — | — | — | — | — | Comparative Example |
| 33 | 0.002 | — | — | — | — | — | — | — | Comparative Example |
| 34 | 0.002 | — | — | — | — | — | — | — | Comparative Example |
| 35 | 0.001 | — | — | — | — | — | — | — | Comparative Example |

TABLE 2

| Sample No. | Steel No. | Thickness (mm) | First rolling conditions: Slab heating temperature (° C.) | First rolling conditions: Rolling finish temperature (° C.) | First rolling conditions: Total rolling reduction (%) | Second rolling conditions: Reheating temperature (° C.) | Second rolling conditions: Rolling finish temperature (° C.) | Second rolling conditions: Total rolling reduction (%) | Cooling conditions: Cooling start temperature (° C.) | Cooling conditions: Cooling rate from cooling start to 650° C. (° C./s) | Number of times descaling is performed | Remarks |
|---|---|---|---|---|---|---|---|---|---|---|---|---|
| 1 | 1 | 20 | 1100 | 890 | 31 | 1100 | 773 | 69 | 737 | 7.0 | 1 | Example |
| 2 | 2 | 20 | 1100 | 903 | 35 | 1100 | 764 | 67 | 718 | 9.0 | 2 | Example |
| 3 | 3 | 25 | 1150 | 934 | 40 | 1150 | 805 | 58 | 763 | 10.0 | 1 | Example |
| 4 | 4 | 25 | 1150 | 882 | 42 | 1150 | 794 | 57 | 738 | 9.0 | 1 | Example |
| 5 | 5 | 30 | 1200 | 951 | 39 | 1200 | 855 | 53 | 827 | 11.0 | 3 | Example |
| 6 | 6 | 30 | 1200 | 947 | 43 | 1200 | 834 | 50 | 815 | 10.0 | 1 | Example |
| 7 | 7 | 15 | 1170 | 912 | 55 | 1170 | 803 | 70 | 750 | 13.0 | 2 | Example |
| 8 | 8 | 15 | 1170 | 919 | 51 | 1170 | 784 | 73 | 721 | 10.0 | 3 | Example |
| 9 | 9 | 6 | 1250 | 1020 | 53 | 1250 | 921 | 95 | 921 | 2.0 | 2 | Example |
| 10 | 10 | 10 | 1250 | 1012 | 43 | 1250 | 746 | 84 | 697 | 8.0 | 1 | Example |
| 11 | 1 | 30 | 1300 | 1104 | 20 | — | 806 | 57 | 775 | 15.0 | 2 | Example |
| 12 | 2 | 30 | 1300 | 805 | 60 | — | — | — | 759 | 14.0 | 2 | Example |
| 13 | 11 | 13 | 1160 | 870 | 47 | 1160 | 780 | 80 | 741 | 7.0 | 3 | Comparative Example |
| 14 | 12 | 13 | 1160 | 883 | 44 | 1160 | 800 | 82 | 746 | 11.0 | 2 | Comparative Example |
| 15 | 13 | 17 | 1210 | 962 | 39 | 1210 | 851 | 69 | 813 | 10.0 | 1 | Comparative Example |
| 16 | 14 | 17 | 1210 | 951 | 35 | 1210 | 832 | 71 | 795 | 12.0 | 3 | Comparative Example |
| 17 | 15 | 23 | 1130 | 939 | 23 | 1130 | 736 | 65 | 671 | 5.0 | 1 | Comparative Example |
| 18 | 16 | 15 | 1200 | 977 | 36 | 1200 | 864 | 77 | 830 | 15.0 | 1 | Comparative Example |
| 19 | 17 | 23 | 1130 | 907 | 38 | 1130 | 745 | 63 | 683 | 3.0 | 2 | Comparative Example |
| 20 | 18 | 25 | 1170 | 903 | 48 | 1170 | 790 | 56 | 761 | 7.0 | 1 | Comparative Example |
| 21 | 19 | 27 | 1150 | 920 | 26 | 1150 | 796 | 59 | 752 | 6.0 | 1 | Comparative Example |
| 22 | 20 | 27 | 1150 | 932 | 23 | 1150 | 787 | 60 | 737 | 11.0 | 3 | Comparative Example |
| 23 | 21 | 20 | 1200 | 948 | 40 | 1200 | 833 | 65 | 786 | 5.0 | 3 | Comparative Example |
| 24 | 22 | 20 | 1200 | 934 | 36 | 1200 | 840 | 66 | 802 | 13.0 | 1 | Comparative Example |
| 25 | 23 | 25 | 1170 | 908 | 46 | 1170 | 776 | 57 | 734 | 8.0 | 1 | Comparative Example |
| 26 | 24 | 10 | 1270 | 1035 | 26 | 1270 | 738 | 87 | 655 | 4.0 | 2 | Comparative Example |
| 27 | 25 | 10 | 1270 | 1046 | 24 | 1270 | 742 | 90 | 665 | 10.0 | 2 | Comparative Example |
| 28 | 1 | 30 | 1100 | 841 | 30 | 1100 | 693 | 60 | 657 | 7.0 | 1 | Comparative Example |
| 29 | 2 | 15 | 1100 | 886 | 18 | 1100 | 741 | 55 | 714 | 14.0 | 1 | Comparative Example |
| 30 | 3 | 30 | 1200 | 924 | 10 | 1200 | 776 | 51 | 685 | 0.5 | 2 | Comparative Example |
| 31 | 4 | 30 | 1150 | 757 | 31 | 1150 | 751 | 55 | 674 | 7.0 | 1 | Comparative Example |
| 32 | 5 | 25 | 1080 | 915 | 21 | 1150 | 786 | 57 | 677 | 3.0 | 3 | Comparative Example |
| 33 | 6 | 25 | 1090 | 830 | 25 | 1150 | 832 | 63 | 795 | 5.0 | 1 | Comparative Example |
| 34 | 7 | 30 | 1250 | 1036 | 21 | 1050 | 735 | 53 | 662 | 12.0 | 2 | Comparative Example |
| 35 | 8 | 20 | 1250 | 995 | 38 | 1300 | 957 | 66 | 928 | 6.0 | 2 | Comparative Example |
| 36 | 9 | 30 | 1300 | 706 | 78 | — | — | — | 655 | 15.0 | 2 | Comparative Example |
| 37 | 1 | 30 | 1200 | 951 | 18 | 1200 | 844 | 51 | 801 | 12.0 | 0 | Comparative Example |
| 38 | 2 | 15 | 1080 | 931 | 22 | 1200 | 836 | 45 | 783 | 10.0 | 1 | Comparative Example |
| 39 | 26 | 30 | 1100 | 850 | 33 | 1100 | 741 | 51 | 713 | 5.0 | 2 | Comparative Example |
| 40 | 27 | 17 | 1100 | 903 | 25 | 1100 | 750 | 83 | 709 | 10.0 | 2 | Comparative Example |
| 41 | 7 | 15 | 1120 | 938 | 41 | 1120 | 763 | 70 | 660 | 7.0 | 1 | Comparative Example |
| 42 | 10 | 13 | 1140 | 956 | 37 | 1140 | 781 | 77 | 725 | 0.5 | 1 | Comparative Example |
| 43 | 28 | 30 | 1150 | 954 | 39 | 1150 | 840 | 56 | 803 | 7.0 | 1 | Example |
| 44 | 29 | 25 | 1200 | 931 | 41 | 1200 | 828 | 60 | 781 | 9.0 | 2 | Example |
| 45 | 30 | 20 | 1250 | 915 | 45 | 1250 | 885 | 63 | 839 | 11.0 | 3 | Example |
| 46 | 31 | 15 | 1200 | 906 | 37 | 1200 | 794 | 72 | 737 | 12.0 | 1 | Comparative Example |
| 47 | 32 | 6 | 1100 | 870 | 54 | 1100 | 780 | 92 | 780 | 1.0 | 2 | Comparative Example |
| 48 | 33 | 15 | 1170 | 902 | 25 | 1170 | 801 | 77 | 742 | 8.0 | 3 | Comparative Example |
| 49 | 34 | 12 | 1100 | 894 | 49 | 1100 | 773 | 81 | 697 | 10.0 | 2 | Comparative Example |
| 50 | 35 | 6 | 1120 | 887 | 51 | 1120 | 764 | 90 | 764 | 1.0 | 1 | Comparative Example |

*Total rolling reduction = rolling reduction calculated from thicknesses at entry and delivery of each of first and second hot rollings

TABLE 3

| | | Microstructure | | | | Mechanical properties | | | | | |
|---|---|---|---|---|---|---|---|---|---|---|---|
| Sample No. | Steel No. | Austenite phase area ratio (%) | Average KAM value | Mn concentration of Mn-concentrated portion (mass %) | Surface roughness Ra (μm) | Yield stress (MPa) | Tensile strength (MPa) | Total elongation (%) | Absorbed energy at −196° C. ($vE_{-196°C.}$) (J) | Percent brittle fracture (%) | Remarks |
| 1 | 1 | 100 | 1.1 | 35.4 | 117 | 430 | 838 | 65 | 127 | 0 | Example |
| 2 | 2 | 100 | 1.1 | 36.1 | 69 | 461 | 813 | 62 | 119 | 0 | Example |
| 3 | 3 | 100 | 0.9 | 28.6 | 160 | 443 | 878 | 61 | 120 | 0 | Example |
| 4 | 4 | 100 | 1.0 | 36.1 | 61 | 428 | 806 | 62 | 112 | 0 | Example |
| 5 | 5 | 100 | 0.7 | 34.7 | 99 | 425 | 828 | 63 | 136 | 0 | Example |
| 6 | 6 | 100 | 0.8 | 38.0 | 200 | 435 | 767 | 59 | 105 | 0 | Example |
| 7 | 7 | 100 | 0.9 | 27.1 | 109 | 463 | 934 | 56 | 109 | 0 | Example |
| 8 | 8 | 100 | 1.0 | 31.2 | 101 | 422 | 841 | 63 | 116 | 0 | Example |
| 9 | 9 | 100 | 0.3 | 35.5 | 151 | 453 | 836 | 64 | 117* | 0 | Example |
| 10 | 10 | 100 | 1.3 | 25.6 | 146 | 429 | 976 | 56 | 103 | 0 | Example |
| 11 | 1 | 100 | 0.9 | 35.8 | 112 | 421 | 846 | 67 | 125 | 0 | Example |
| 12 | 2 | 100 | 0.7 | 36.3 | 156 | 444 | 797 | 63 | 125 | 0 | Example |
| 13 | 11 | 100 | 1.1 | 36.9 | 123 | 506 | 807 | 54 | 90 | 11 | Comparative Example |
| 14 | 12 | 100 | 0.9 | 24.5 | 121 | 374 | 802 | 68 | 109 | 0 | Comparative Example |
| 15 | 13 | 100 | 0.7 | 38.2 | 205 | 407 | 774 | 56 | 63 | 32 | Comparative Example |
| 16 | 14 | 100 | 0.8 | 29.8 | 70 | 435 | 884 | 53 | 86 | 14 | Comparative Example |
| 17 | 15 | 100 | 1.4 | 25.4 | 143 | 423 | 880 | 53 | 89 | 13 | Comparative Example |
| 18 | 16 | 100 | 0.7 | 37.1 | 212 | 450 | 868 | 60 | 114 | 0 | Comparative Example |
| 19 | 17 | 100 | 1.3 | 24.0 | 98 | 474 | 950 | 51 | 90 | 12 | Comparative Example |
| 20 | 18 | 100 | 1.0 | 35.7 | 208 | 405 | 802 | 48 | 105 | 0 | Comparative Example |
| 21 | 19 | 100 | 1.0 | 32.5 | 99 | 455 | 839 | 50 | 83 | 13 | Comparative Example |
| 22 | 20 | 100 | 1.1 | 28.3 | 64 | 525 | 767 | 44 | 74 | 15 | Comparative Example |
| 23 | 21 | 95 | 0.7 | 25.1 | 45 | 366 | 783 | 66 | 113 | 0 | Comparative Example |
| 24 | 22 | 100 | 0.6 | 37.3 | 190 | 518 | 794 | 47 | 87 | 13 | Comparative Example |
| 25 | 23 | 100 | 1.1 | 25.1 | 81 | 436 | 813 | 52 | 91 | 11 | Comparative Example |
| 26 | 24 | 100 | 1.5 | 26.4 | 113 | 458 | 752 | 54 | 96 | 11 | Comparative Example |
| 27 | 25 | 100 | 1.4 | 27.8 | 106 | 418 | 764 | 52 | 90 | 11 | Comparative Example |
| 28 | 1 | 100 | 1.6 | 36.1 | 163 | 483 | 808 | 49 | 87 | 13 | Comparative Example |
| 29 | 2 | 100 | 1.5 | 38.4 | 207 | 475 | 776 | 51 | 60 | 35 | Comparative Example |
| 30 | 3 | 100 | 1.5 | 38.1 | 181 | 434 | 800 | 42 | 86 | 13 | Comparative Example |
| 31 | 4 | 100 | 1.5 | 38.7 | 210 | 440 | 741 | 43 | 55 | 40 | Comparative Example |
| 32 | 5 | 100 | 1.0 | 38.3 | 150 | 465 | 772 | 45 | 73 | 17 | Comparative Example |
| 33 | 6 | 100 | 0.7 | 39.2 | 209 | 451 | 753 | 48 | 53 | 49 | Comparative Example |
| 34 | 7 | 100 | 1.5 | 27.4 | 121 | 480 | 905 | 52 | 93 | 11 | Comparative Example |
| 35 | 8 | 100 | 0.2 | 31.4 | 106 | 376 | 793 | 65 | 121 | 0 | Comparative Example |
| 36 | 9 | 100 | 1.7 | 36.3 | 103 | 558 | 795 | 43 | 80 | 14 | Comparative Example |
| 37 | 1 | 100 | 0.8 | 38.5 | 224 | 424 | 981 | 58 | 76 | 15 | Comparative Example |
| 38 | 2 | 100 | 0.5 | 38.4 | 207 | 456 | 819 | 55 | 79 | 14 | Comparative Example |
| 39 | 26 | 90 | 0.8 | 22.3 | 65 | 422 | 936 | 63 | 78 | 15 | Comparative Example |
| 40 | 27 | 95 | 1.3 | 23.0 | 108 | 404 | 946 | 57 | 95 | 11 | Comparative Example |
| 41 | 7 | 100 | 1.1 | 26.8 | 150 | 471 | 928 | 55 | 89 | 12 | Comparative Example |
| 42 | 10 | 100 | 1.2 | 25.3 | 73 | 435 | 970 | 55 | 85 | 13 | Comparative Example |
| 43 | 28 | 100 | 0.7 | 27.5 | 178 | 444 | 870 | 65 | 125 | 0 | Example |
| 44 | 29 | 100 | 0.9 | 37.7 | 136 | 458 | 833 | 61 | 135 | 0 | Example |
| 45 | 30 | 100 | 0.5 | 30.5 | 111 | 432 | 856 | 63 | 116 | 0 | Example |
| 46 | 31 | 100 | 1.3 | 25.3 | 175 | 510 | 931 | 52 | 88 | 13 | Comparative Example |
| 47 | 32 | 100 | 1.5 | 23.9 | 101 | 483 | 906 | 54 | 95* | 11 | Comparative Example |
| 48 | 33 | 90 | 1.3 | 23.1 | 75 | 451 | 854 | 57 | 81 | 14 | Comparative Example |
| 49 | 34 | 100 | 1.4 | 35.4 | 87 | 505 | 891 | 55 | 92 | 12 | Comparative Example |
| 50 | 35 | 100 | 1.5 | 24.0 | 180 | 478 | 879 | 56 | 98* | 11 | Comparative Example |

*value obtained by multiplying absorbed energy in 5 mm subsize test piece by 1.5

Each high-Mn steel according to the present disclosure satisfied the foregoing target performance (i.e. the yield stress of base metal is 400 MPa or more, the low-temperature toughness is 100 J or more in average absorbed energy ($vE_{-196}$), the percent brittle fracture is less than 10%, and the surface roughness Ra is 200 μm or less). Each Comparative Example outside the range according to the present disclosure failed to satisfy the target performance in at least one of the yield stress, the low-temperature toughness, and the surface roughness.

The invention claimed is:

1. A high-Mn steel comprising:

a chemical composition consisting of, in mass %,

C: 0.100% or more and 0.700% or less,

Si: 0.05% or more and 1.00% or less,

Mn: 20.0% or more and 35.0% or less,

P: 0.030% or less,

S: 0.0070% or less,

Al: 0.010% or more and 0.070% or less,

Cr: 0.50% or more and 5.00% or less,

N: 0.0050% or more and 0.0500% or less,
O: 0.0050% or less,
Ti: 0.005% or less,
Nb: 0.005% or less, and
optionally at least one group selected from the following (A) to (B);
(A) one or more selected from
Cu: 0.01% or more and 0.50% or less,
Mo: 2.00% or less,
V: 2.00% or less, and
W: 2.00% or less;
(B) one or more selected from
Ca: 0.0005% or more and 0.0050% or less,
Mg: 0.0005% or more and 0.0050% or less, and
REM: 0.0010% or more and 0.0200% or less,
with a balance consisting of Fe and inevitable impurities; and
a microstructure having austenite as a matrix,
wherein in the microstructure, a Mn concentration of a Mn-concentrated portion is 38.0% or less, and an average of Kernel Average Misorientation value is 0.3 or more,
yield stress is 400 MPa or more,
absorbed energy vE−196 in a Charpy impact test at −196° C. is 100 J or more, and
percent brittle fracture is less than 10%, and
wherein the high Mn steel has a surface roughness Ra of 200 μm or less.

2. The high-Mn steel according to claim 1, wherein the chemical composition contains, in mass %, at least one group selected from the following (A) to (B);
(A) one or more selected from
Cu: 0.01% or more and 0.50% or less,
Mo: 2.00% or less,
V: 2.00% or less, and
W: 2.00% or less;
(B) one or more selected from
Ca: 0.0005% or more and 0.0050% or less,
Mg: 0.0005% or more and 0.0050% or less, and
REM: 0.0010% or more and 0.0200% or less.

3. The high-Mn steel according to claim 1, wherein the high Mn steel has thickness of 6 mm to 30 mm.

* * * * *